US012503850B2

(12) United States Patent
Tougne et al.

(10) Patent No.: US 12,503,850 B2
(45) Date of Patent: Dec. 23, 2025

(54) DEMOUNTABLE WALL PARTITION SYSTEM

(71) Applicant: SAINT-GOBAIN PLACO, Courbevoie (FR)

(72) Inventors: Gaël Tougne, Köpenhamn (DK); Uffe Jespersen, Söndersö (DK)

(73) Assignee: SAINT-GOBAIN PLACO, Courbevoie (FR)

( * ) Notice: Subject to any disclaimer, the term of this patent is extended or adjusted under 35 U.S.C. 154(b) by 461 days.

(21) Appl. No.: 18/247,398

(22) PCT Filed: Oct. 4, 2021

(86) PCT No.: PCT/EP2021/077259

§ 371 (c)(1),
(2) Date: Mar. 30, 2023

(87) PCT Pub. No.: WO2022/073911

PCT Pub. Date: Apr. 14, 2022

(65) Prior Publication Data

US 2023/0407630 A1 Dec. 21, 2023

(30) Foreign Application Priority Data

Oct. 5, 2020 (EP) ..... 20200055

(51) Int. Cl.
*E04B 2/74* (2006.01)

(52) U.S. Cl.
CPC .... *E04B 2/7407* (2013.01); *E04B 2002/7464* (2013.01)

(58) Field of Classification Search
CPC ..... E04B 2002/7464; E04B 2002/7466; E04B 2/7401; E04B 2/7407; E04B 2/7403
See application file for complete search history.

(56) References Cited

U.S. PATENT DOCUMENTS 3,852,927 A * 12/1974 Birum, Jr. ..... E04B 2/789 52/489.1
3,866,377 A * 2/1975 De Schutter ..... E04B 2/7401 52/712

(Continued)

FOREIGN PATENT DOCUMENTS

DE 85 01 877 U1 8/1986
EP 2166169 A1 * 3/2010 ..... E04B 2/7409

(Continued)

OTHER PUBLICATIONS

International Search Report Issued Jan. 19, 2022, in PCT/EP2021/077259, filed on Oct. 4, 2021, 3 pages.

(Continued)

*Primary Examiner* — Adriana Figueroa
(74) *Attorney, Agent, or Firm* — Oblon, McClelland, Maier & Neustadt, L.L.P.

(57) ABSTRACT

A demountable wall partition system includes a first and a second demountable partition panel each including a board and having a front surface and a rear surface, and a flange connection element. At least one panel mount bracket is connected to each board and protrudes from the rear surface and includes a first end flange extending in a first flange plane parallel with the rear surface of the board and a second end flange. The panels are arranged spaced apart with the rear surfaces facing each other such that the at least one panel mount bracket of the respective panel form at least one pair of aligned panel mount brackets, wherein said brackets are connected to each other by means of the flange connection element which is connected to the end flanges of the brackets such that the flange connection element is supported by the brackets.

15 Claims, 10 Drawing Sheets

(56) References Cited

U.S. PATENT DOCUMENTS

| | | | | | |
|---|---|---|---|---|---|
| 4,128,979 | A | * | 12/1978 | Price | E04B 2/763 52/489.1 |
| 4,655,014 | A | | 4/1987 | Krecke | |
| 4,719,730 | A | * | 1/1988 | Winkowski | E04B 2/7411 52/489.1 |
| 5,060,434 | A | * | 10/1991 | Allison | E04B 2/7411 52/745.12 |
| 5,216,859 | A | * | 6/1993 | Moreno | E04B 2/7411 52/489.2 |
| 2019/0024394 | A1 | | 1/2019 | Bianchi | |

FOREIGN PATENT DOCUMENTS

| | | | | | |
|---|---|---|---|---|---|
| GB | 1 120 632 | A | | 7/1968 | |
| GB | 1 439 018 | A | | 6/1976 | |
| GB | 2225359 | A | * | 5/1990 | E04B 2/7409 |
| GB | 2575406 | B | * | 3/2022 | |

OTHER PUBLICATIONS

United Arab Emirates Office Action issued May 7, 2025 in United Arab Emirates Patent Application No. P6000772/2023, 5 pages.

* cited by examiner

DEMOUNTABLE WALL PARTITION SYSTEM

FIELD OF THE INVENTION

The invention relates to a demountable wall partition system. More specifically, the invention relates to a demountable wall partition system comprising opposed partition panels each having a board and a panel mount bracket attached thereto.

BACKGROUND ART

Today, office spaces can be built by using pre-fabricated partition wall systems or by using removeable partition systems (such as free-standing room dividers). These ways of building office spaces require skill and takes a considerable time to build or have less beneficial acoustic, fire and/or thermal insulation properties. Further, when the office space needs to be altered or is removed, the walls are constructed and built in such a way that the wall is at least partly destroyed when taken down and can therefore not easily be reused.

It would therefore be beneficial to have partition walls that can be easily demounted and reused.

SUMMARY OF THE INVENTION

In view of that stated above, the object of the present invention is to at least partly overcome one or more of the above-identified limitations of the prior art. In particular, it is an object to provide a demountable and reusable partition panel or wall system.

To achieve at least one of the above objects and also other objects that will be evident from the following description, a demountable wall partition system having the features defined in claim 1 and a method for installing a demountable wall partition system having the features defined in claim 15 are provided according to the present invention. Preferred embodiments will be evident from the dependent claims.

More specifically, there is provided according to a first aspect of the present invention a demountable wall partition system comprising, a first and a second demountable partition panel, and a flange connection element. Each of the first and second demountable partition panel has a front surface, a rear surface and side edges connecting the front surface and the rear surface, and comprises a board having a rear surface forming the rear surface of the associated first or second demountable partition panel and at least one panel mount bracket connected to the board and protruding from the rear surface, the at least one panel mount bracket comprising a first end flange extending in a first flange plane parallel with the rear surface of the board and a second end flange. The first and second demountable partition panels are arranged spaced apart with the rear sides facing each other such that the at least one panel mount bracket of the respective first and second demountable partition panel form at least one pair of aligned panel mount brackets. The at least one pair of aligned panel mount brackets are connected to each other by means of the flange connection element which is connected to the end flanges of the at least one pair of aligned panel mount brackets such that the flange connection element is supported by the at least one pair of aligned panel mount brackets.

Hereby, a demountable wall partition system is provided enabling easy demounting of a partition panel with maintained integrity and thus also reuse of the demounted partition panel.

Each of the first and second partition panel is provided with at least one panel mount bracket protruding from the rear surface of the board and connected to the panel mount bracket of the opposing partition panel. Thus, the first and second partition panel may easily be used for erecting a partition wall and may subsequently, if need arises, be demounted from the partition wall and reused.

The at least one pair of aligned panel mount brackets are connected to each other by means of the flange connection element which is connected to the end flanges of the at least one pair of aligned panel mount brackets such that the flange connection element is supported by the at least one pair of aligned panel mount brackets. Hereby, each of the first and second partition panel may be reliable connected to, and subsequently if necessary disconnected from the opposing partition panel.

The flange connection element may be an elongated profile configured to receive the second end flanges of the pair of aligned mount brackets. Hereby, the flange connection element may be shaped as a slide profile configured to be slid over the second end flanges for connecting the pair of aligned panel mound brackets to each other. The elongated profile may have a c-shaped cross section.

The demountable wall partition system may further comprise an insulating material arranged in a void formed between the first and second demountable partition panels. The provision of insulating material in the void may improve the acoustical properties of the wall partition system.

The first end flange of each panel mount bracket may be attached to the rear surface of the associated board. The use of a board thus facilitates secure attachment of the panel mount bracket to the rear surface of the board, for instance by means of screws. Alternatively, the end flange may be embedded in the board or, in case the partition panels comprises several boards, sandwiched between two boards.

At least one of the first and second demountable partition panel may comprise an edge cover at least partly covering the side edges. The provision of the edge cover may protect the side edges of the first and/or second demountable partition panel during handling and transportation. The edge cover may be configured to form a frame structure, thereby providing additional rigidity to the first and/or second partition panel. The edge cover may comprise an L-shaped profile extending along one of the side edges. The L-shaped profile may comprise a flange extending in parallel with the one side edge and having a width which is smaller than a thickness of the first and/or second demountable partition panel. Hereby, the L-shaped profile may be arranged with one flange extending in parallel with and attached to the rear surface of the board, while the other flange extends in parallel with the side edge providing protection thereto without being visible from the front surface of the first and/or second demountable partition panel.

At least one of the first and second demountable partition panel may comprise an additional board facing a front surface of the board. Hereby, the first and/or second demountable partition panel may have sandwiched structure improving acoustical properties of the first and/or second demountable partition panel. The additional board may be glued to the board.

The demountable wall partition system may comprise a gasket arranged between the at least one pair of aligned panel mount brackets. The provision of a gasket may reduce transmission of sound through demountable wall partition system.

The second end flanges of the at least one pair of aligned panel mount brackets may each extend in a direction having a component being perpendicular to the associated rear surface of the board. Further, each second end flange may extend from a first position towards a second position, corresponding to a free end of the second end flange, the second position being spaced apart from the associated rear surface of the board, wherein a distance between the rear surface and the second position is greater than a distance between the rear surface and the first position. Hereby, the the at least one pair of aligned panel mount brackets may be connected to each other by means of the flange connection element gripping over the respective free end of the second end flanges thereby securing the relative position of the first and second demountable partition panels in both lateral and vertical direction.

The first and/or second demountable partition panel may comprise a plurality of panel mount brackets distributed on the associated rear surface in a spaced apart manner.

The board of at least one of the first and second demountable partition panel may be a gypsum board and more preferably a reinforced gypsum board.

The flange connection element may be an elongated profile configured to receive the second end flanges of the pair of aligned mount brackets. Hereby, the flange connection element may be shaped as a slide profile configured to be slid over the second end flanges for connecting the pair of aligned panel mound brackets to each other. The elongated profile may have a c-shaped cross section.

According to a second aspect of the present invention, a method for installing a demountable wall partition system is provided. The method comprises arranging the first and second demountable partition panel as described above such that the at least one panel mount bracket of the first demountable partition panel opposes the at least one panel mount bracket of the second demountable partition panel thereby forming at least one pair of aligned panel mount brackets and connecting the flange connection element to the end flanges of the at least one pair of aligned panel mount brackets such that the flange connection element is supported by the at least one pair of aligned panel mount brackets.

Throughout this application a reinforced gypsum board is to be understood as a gypsum board or plasterboard that can be reinforced with a backing lamina or without a backing lamina. The reinforced gypsum board may comprise more than 50 wt % gypsum and, relative to the gypsum, at least 1 wt % fibres (e.g. glass fibres) embedded in the set gypsum core and at least 1 wt % polymeric additive. The polymeric additive may comprise starch or synthetic polymers such as polyvinyl acetate. The board may comprise multiple different types of polymeric additive. The reinforced gypsum board may also comprise between 45 and 85%-by-weight calcium sulphate dihydrate, between 5 and 15%-by-weight of paper fibres. The reinforced gypsum board may be a gypsum fibre board.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIG. 7 is a side view of a pair of aligned panel mount brackets having a gasket arranged between.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
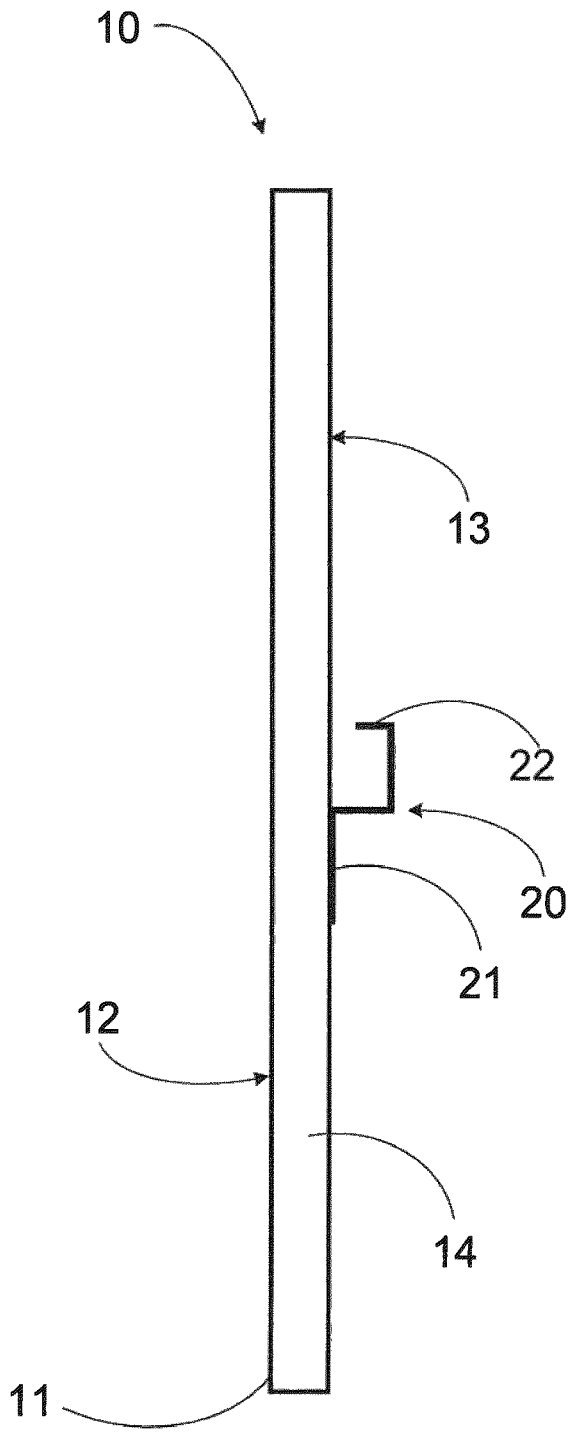
FIG. 1 is a side view a demountable partition panel.

FIG. 1, to which reference is made, illustrates a demountable partition panel 10.

The demountable partition panel 10 has a front surface 12, a rear surface 13 and side edges 14 that connect the front 12 and rear surface 13.

The demountable partition panel 10 comprises a board 11 and in the shown embodiment it is thus the board 11 that forms the front surface 12, the rear surface 13 and the side edges 14 connecting the front 12 and rear surface 13 of the panel 10.

Figure 6:
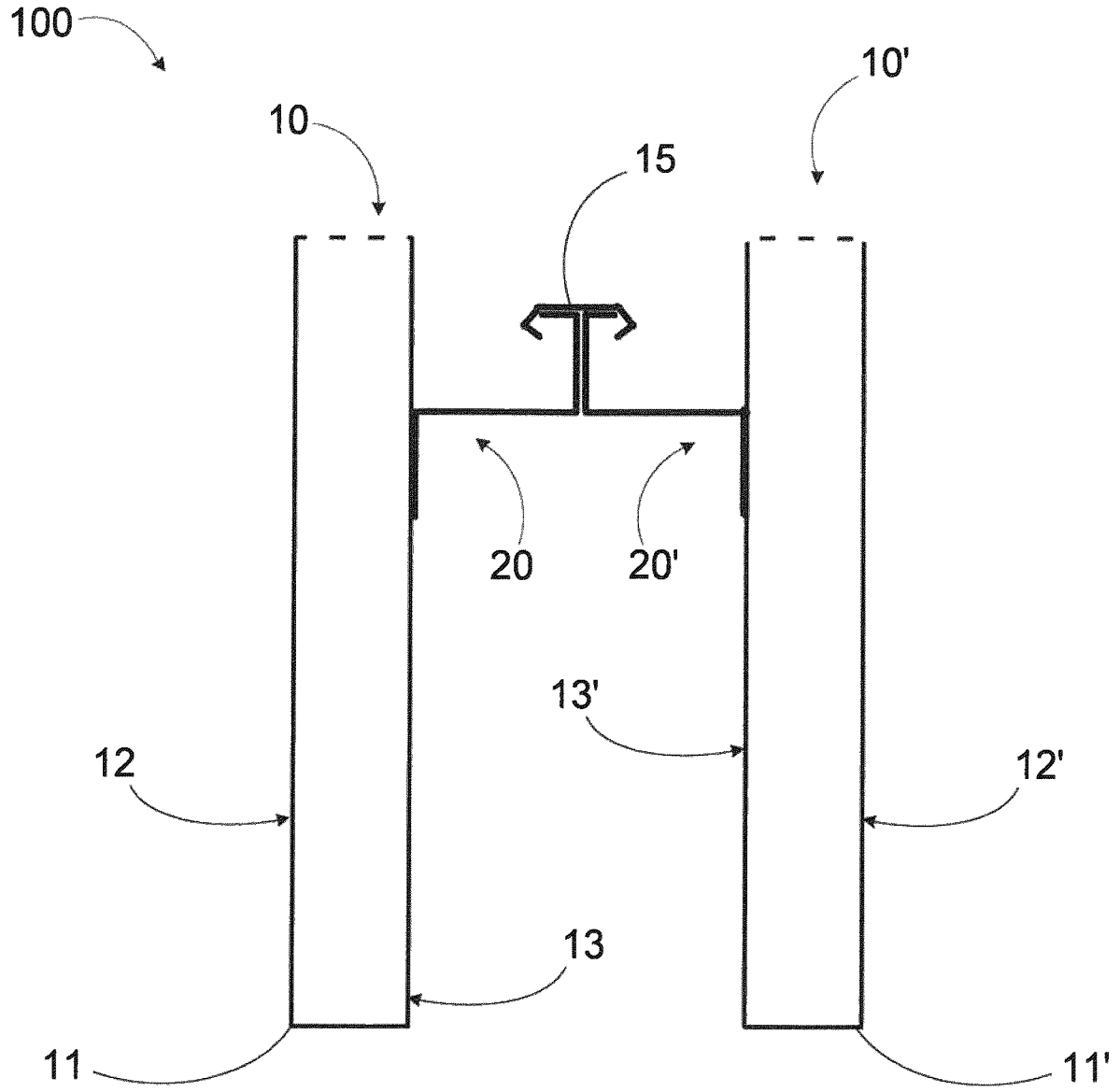
FIG. 6 is a side view of a demountable partition system.

The demountable partition panel 10 also comprises at least one panel mount bracket 20 connected to the board 11 and configured for connection to a panel mount bracket 20 of an opposing demountable partition panel 10 by means of a flange connection element 15 (shown in FIG. 6).

The at least one panel mount bracket 20 comprises a first end flange 21 extending in a first flange plane parallel with and attached to the rear surface 13 of the board 11. The at least one panel mount bracket 20 further comprises a second end flange 22 configured to be connected to a second end flange of a panel mount bracket of an opposing demountable partition panel, and in the shown embodiment, the second end flange is configured to be connected to the second end flange of the opposing demountable partition panel by means of the flange connection element 15.

By having the panel mount bracket 20 attached to the board 11 a simple, durable and stable demountable wall partition panel 10 is provided. This allows for easier installation, demounting and reusability of the demountable wall partition panel 10. The demountable wall partition panel 10 reduces time, waste and any on-site preparations for constructing temporary walls for offices or rooms.

The board 11 can ba any type of board 11 that allows for the attachment of the panel mount bracket 20 to the board 11 by for example gluing or screwing. The board 11 could in some examples be a board 11 that has an average screw pull-out strength of more than 500 N. The board 11 may for example be a reinforced gypsum board 11 or a reinforced gypsum board 11 having an average screw pull-out strength of more than 500 N. It would normally not be possible to attach the panel mount bracket 20 to a standard gypsum board by screwing the panel mount bracket 20 to the standard gypsum board due to the friability of standard gypsum boards.

The demountable partition panel 10 may have a width between 500-1000 mm, or more preferably between 600-900 mm, such as a standard board width. Additionally, since the panel mount bracket 20 is attached to the rear surface 13 of the board 11, the front surface 12 is untouched and can be customized according to any need. The panel mount bracket 20 can be made of metal such as galvanized steel and/or aluminium, composite materials and/or of plastic.

The panel mount bracket 20 can be pre-attached to the board 11 when for example producing the demountable partition wall panel 10 in a production line. The panel mount bracket 20 can also be attached when building the wall for the office or room. The attachment of the panel mount bracket 20 to the board 11 can be by use of glue, screws, nails, tape or any other suitable attachment method. The panel mount bracket 20 may also be integrated into the slurry when forming the board 11. The panel mount bracket 20 may also be embedded between for example two boards 11 by having the first flange 21 arranged between the two boards 11 and the second flange 22 sticking out on the back side of one of the boards 11.

Figure 2:
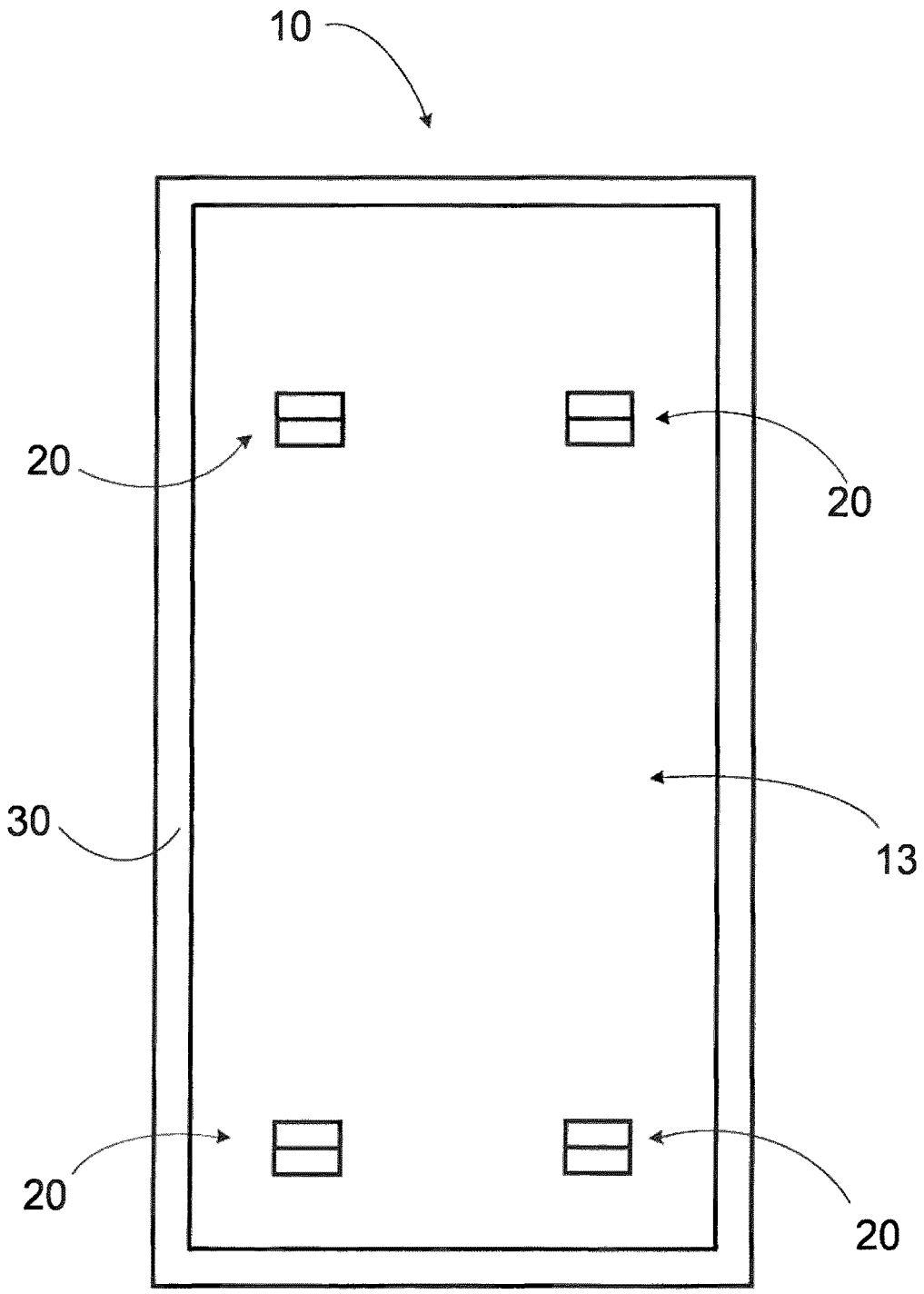
FIG. 2 is a side view a demountable partition panel comprising a plurality of panel mount brackets.
Figure 3:
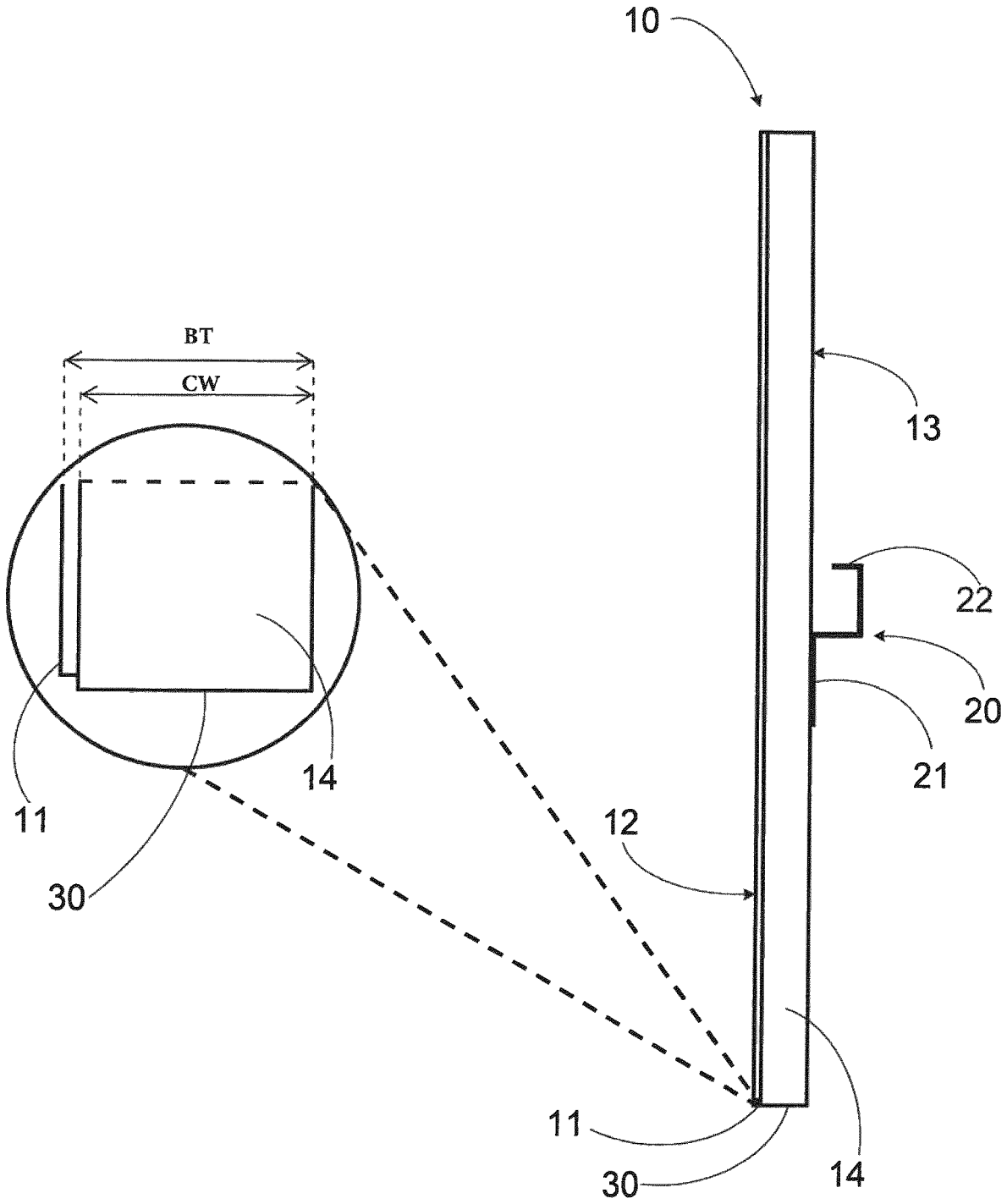
FIG. 3 is a side view a demountable partition panel comprising an edge cover.

As illustrated in FIG. 2, the demountable partition panel 10 may comprise a plurality of panel mount brackets 20 distributed on the rear surface 13 in a spaced apart manner. The panel mount brackets 20 may be arranged in such a way that gives most stability to a wall system 100 comprising two or more demountable partition panels 10. The panel mount brackets 20 may also be arranged in such a way to accommodate placement of technical components such as switches, sockets and/or steering. The panel mount brackets 20 may also be arranged in such a way to accommodate wiring or other components that should run behind the demountable partition panel 10.

The demountable partition panel 10 may have an edge cover 30, also illustrated in FIG. 2. The edge cover 30 covers at least partly the side edges 14. By at least partly covering the side edges 14 of the partition panel 10, the partition panel 10 is protected from accidently being damaged during storing, handling or transportation. The edge cover 30 may also only cover some of the side edges 14, such as a bottom and top side edges 14. The edge cover is in some example made up by several edge cover elements or the edge cover 30 can be made up by one coherent edge cover element. The edge cover 30 may also form a frame structure. The edge cover 30 may form the frame structure as fitted separate edge cover elements 30 or as a single frame element edge cover 30. The frame structure improves stability and/or durability of the demountable partition panel 10.

The edge cover 30 may have a length between 500-2500 mm or any length for fitting around the partition panel 10 or at least parts of the partition panel 10. The edge cover 30 may also be long enough to cover a plurality of partition panel 10. For example the edge cover 30 may be made to cover a side edge 14 facing a floor and the edge cover 30 may then adapted in length to cover two partition panel 10 placed next to each other.

The edge cover 30 comprises in some examples an L-shaped profile extending along at least one of the side edges 14. The L-shaped profile comprises one flange 31 extending parallel to one side edge 14 and has a width CW smaller than a thickness BT of the partition panel 10. By having the width CW of one flange 31 being smaller than the thickness BT of the partition panel 10, the front surface 12 is free from any edge cover 30 and thus clean and ready to be customized as desired. Also, the edge cover 30 will be less visible.

The other flange of the L-shaped profile may be attached to the rear surface 13 by glue and/or screw. The width CW and/or height of the L-shaped profile may be between 10-50 mm, more preferably between 20-25 mm. The L-profile may also comprise pre-drilled holes for easier attachment by screws to the board 11.

The edge cover 30 may also completely cover the side edges 14 and thus being visible and contacting both the front and rear surface 12, 13.

Figure 4:
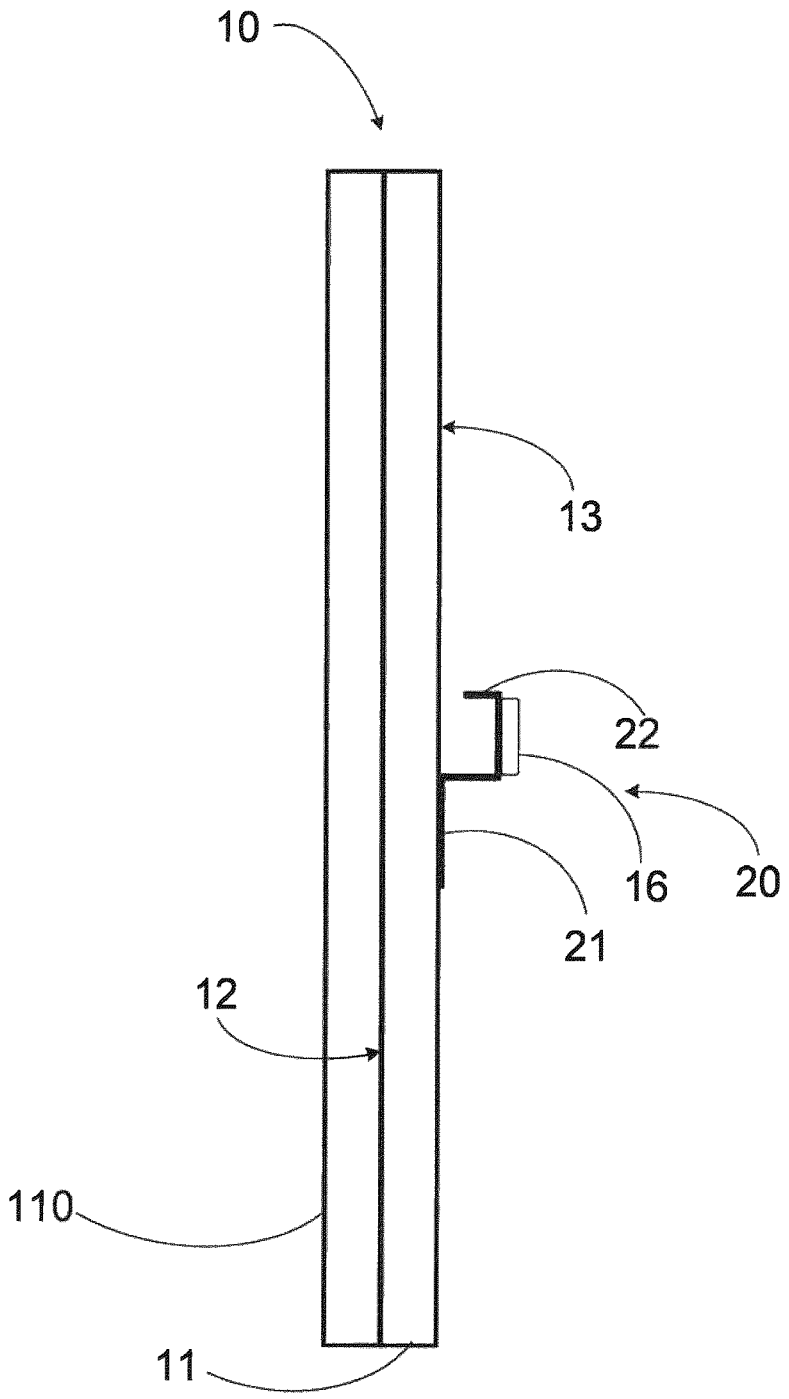
FIG. 4 is a side view a demountable partition panel comprising an additional board.

The demountable partition panel 10 comprises in some examples an additional board 110 facing the front surface 12 of the board 11, illustrated in FIG. 4. The demountable partition panel may thus be provided with a sandwich structure. By adding the additional board 110 the demountable partition panel 10 can be further improved or customized. For example the additional board 110 may be adapted for better sound proofing or have better resistance against fire and/or moisture or other desired structural features. The additional board 110 may also improve the structural strength and/or durability of the demountable partition panel 10. The additional board 110 my be a board and/or a standard board. The demountable partition panel 10 may comprise more elements and/or boards than the board 11 and the additional board 110.

In some examples the board 11 and the additional board 110 are glued together. The board 11 and the additional board 110 may be glued together in a uniform or a non-uniform application of the glue. Other examples of connecting the board 11 and the additional board 110 together may be by using tape. The board 11 and the additional board 110 my also be hold together by the edge cover 30 completely covering the side edges 14 and thus being visible and contacting both a front surface of for example the additional board 110 and the rear surface of the board 11. The board 11 and the additional board 110 may also be glued to the edge cover 30. The board 11 and the additional board 110 may also be glued to the edge cover 30 and between the board 11 and the additional board 110.

In an example the demountable partition panel 10 comprises a gasket 16 arranged on the panel mount bracket 20 and configured to abut the panel mount bracket of an opposing demountable partition panel. The gasket 16 acts as a sound isolating member between the two panel mount brackets and their respective demountable partition panels.

Figure 5B:
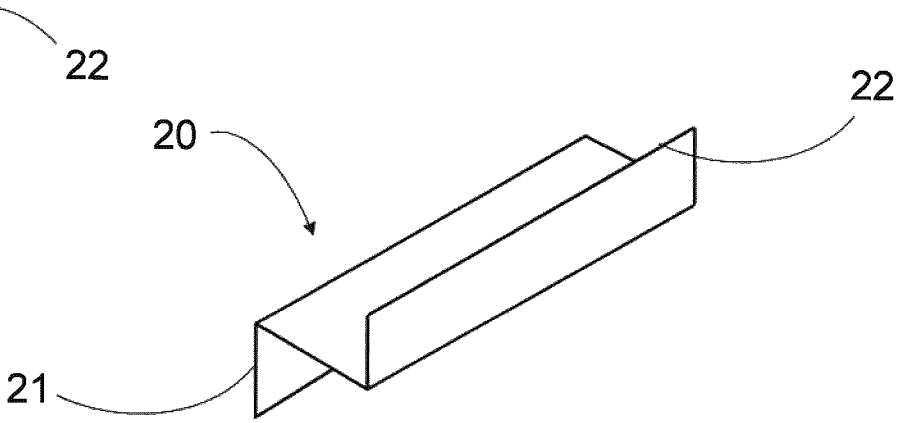
FIGS. 5A-5D are perspective and side views of panel mount brackets.

In some examples the second end flange 22 of the at least one panel mount bracket 20 extends in a direction having a component being perpendicular to the rear surface 13 of the board 11, illustrated in e.g. FIGS. 5A-5D. By extending the second end flange 22 perpendicular to the rear surface 13, the panel mount bracket 20 is formed such that the flange connection element connects and secures together two panel mount brackets 20 and their respective partition panel 10. The panel mount bracket 20 may also be shaped as illustrated in FIG. 5B and the difference from for example 5A is that that the second end flange 22 also extends parallel to the rear surface 13 as for the first end flange 21. The flange connection element 15 in may thus simply be clamped or fitted to secure two panel mount brackets together.

Figure 5A:
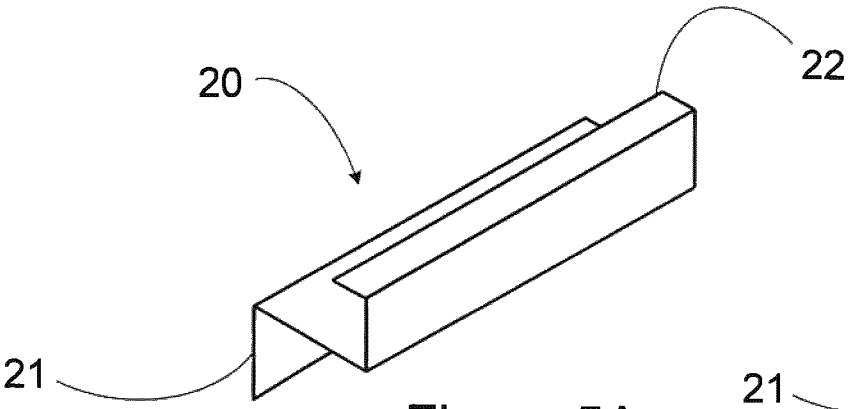
Figure 5C:
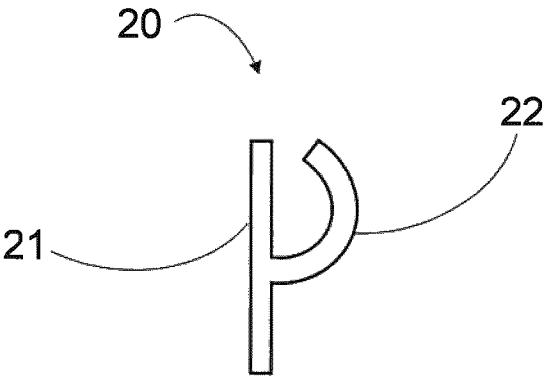

The second end flange 22 may extend in the direction perpendicular to the rear surface 13 from a first position towards a second position corresponding to a free end of the second end flange 22, wherein the second position is spaced apart from the rear surface 13 but still closer to the rear surface 13 than the first position as illustrated in e.g. FIGS. 5A and 5C. Such a configuration of the second end flange 22 enables connection of a pair of aligned panel mount brackets 20 by means of the flange connection element 15 gripping over the free ends of the second end flanges 22, thereby securing the connection of the pair of aligned panel mount brackets 20 in both a lateral and vertical direction. The flange connection element 15 and/or the panel mount bracket 20 may be shaped to exert a force such as a spring force on the panel mount bracket 20 and/or the flange connection element 15, improving the connection between the two panel mount brackets 20. For example, illustrated in FIG. 5C is a panel mount bracket 20 being shaped such that the second end flange 22 is curved such that a force is exerted on the connection element 15 as well as the second end flange 22 being substantially perpendicular to the rear surface 13. Alternatively the second end flange 22 may be completely perpendicular.

Figure 5D:
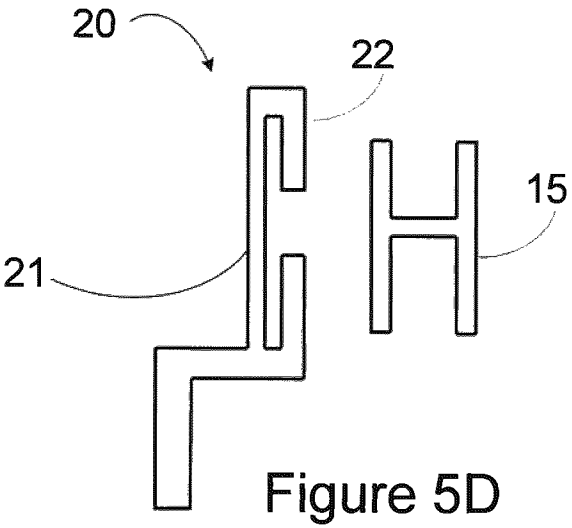

It would also be possible to shape the panel mount bracket 20 and the flange connection element 15 to be geometrically fitted to each other as for example illustrated in FIG. 5D. In 5D the flange connection element 15 has a H-profile shape and the panel mount bracket 20 is shaped to fit with one side of the H-profile. The panel mount bracket 20 and the flange connection element 15 may also be shaped as female/male connection.

Illustrated in FIG. 6 is a demountable wall partition system 100. The demountable wall system 100 comprises a first and a second demountable partition panel 10, 10'. The first and second demountable partition panels 10, 10' are arranged spaced apart with the rear sides 13, 13' facing each other such that the at least one panel mount bracket 20, 20' of the respective first and second demountable partition panel 10, 10' form at least one pair of aligned panel mount brackets 20, 20'. The demountable wall system 100 further comprises the flange connection element 15 connecting the at least one pair of aligned mount brackets 20, 20'. The flange connection element 15 thus connects the first and second demountable partition panels (10, 10') to each other while being supported by the pair of aligned panel mount brackets (20, 20')

By using two demountable wall partition panels 10, 10' and arranging the two demountable wall partition panels 10, 10' such that at least one pair of aligned panel mount brackets 20, 20' is formed, it is possible to quickly and easily effect a partition wall, and the partition wall may easily be demounted into demountable partition panels 10, 10' that may be reused. The demountable wall partition system 100 may comprise a plurality of these first and second demountable partition panels 10, 10' arranged next to each other forming a continuous partition wall structure.

The flange connection element 15 may be an elongated profile configured to receive the second end flanges 22, 22' of the pair of aligned mount brackets 20, 20'. In an example the elongated profile has a C-shaped cross section. The flange connection element 15 may have any length. The length of the flange connection element 15 may for instance be long enough to cover at least two adjacent pairs of aligned mount brackets 20, 20', illustrated in FIG. 9.

Figure 9:
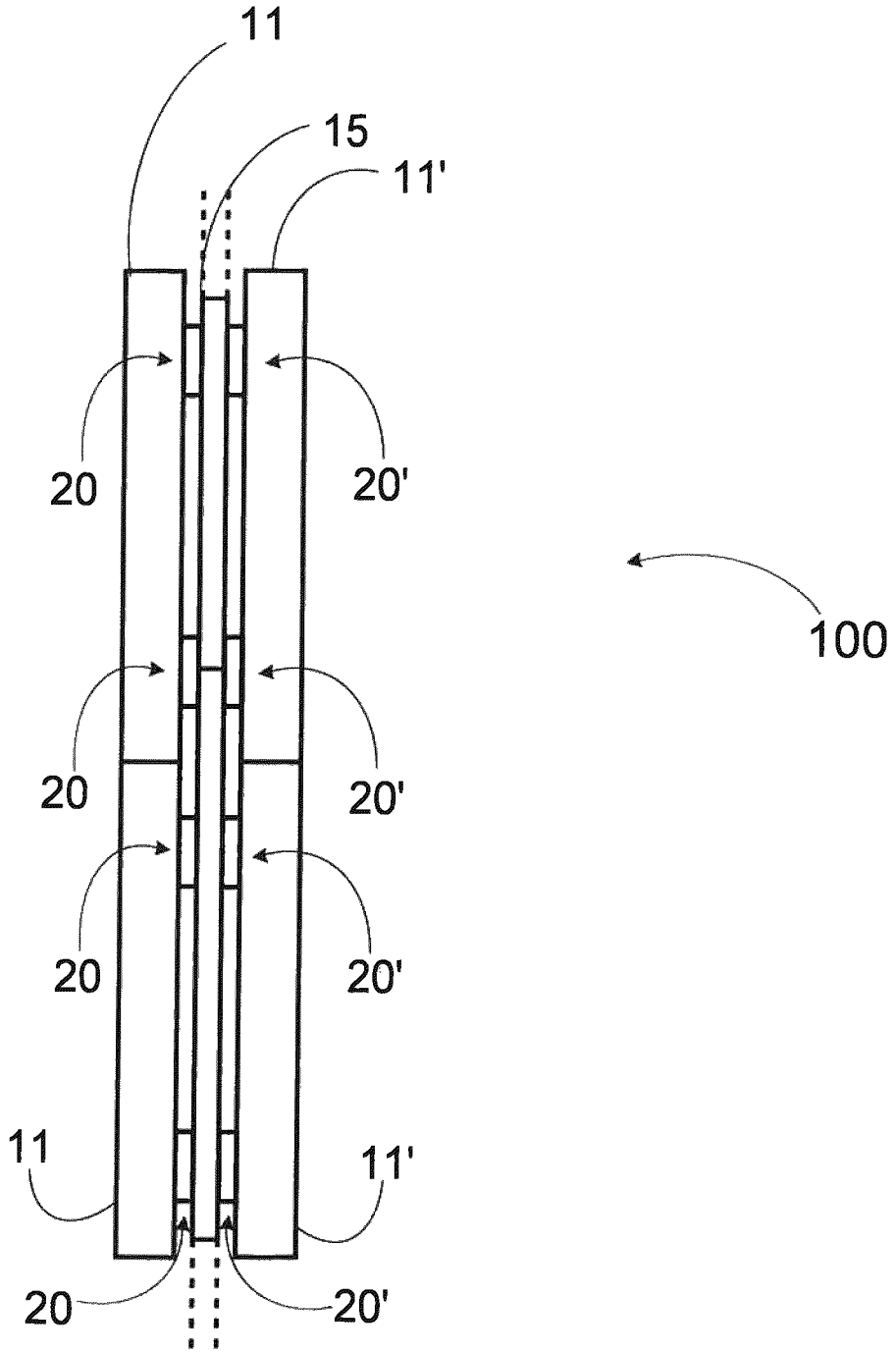
FIG. 9 is a top view of a layout of a demountable wall partition system.

Two adjoining flange connection elements 15 may as illustrated in FIG. 9 form a joint at a common pair of aligned panel mount brackets 20, thereby improving the rigidity of the demountable wall partition system 100.

The flange connection element 15 may be shaped, for example the elongated C-shaped profile, such that the flange connection element can be slid over and connecting the second end flanges 22, 22' of the pair of aligned mount brackets 20, 20'. The slidable flange connection element 15 facilitates assembly of the demountable wall partition system 100 since any person could simply slide the flange connection element 15 from an open side of the demountable wall partition system 100, in between the demountable partition panels 10 to connect them.

Figure 10:
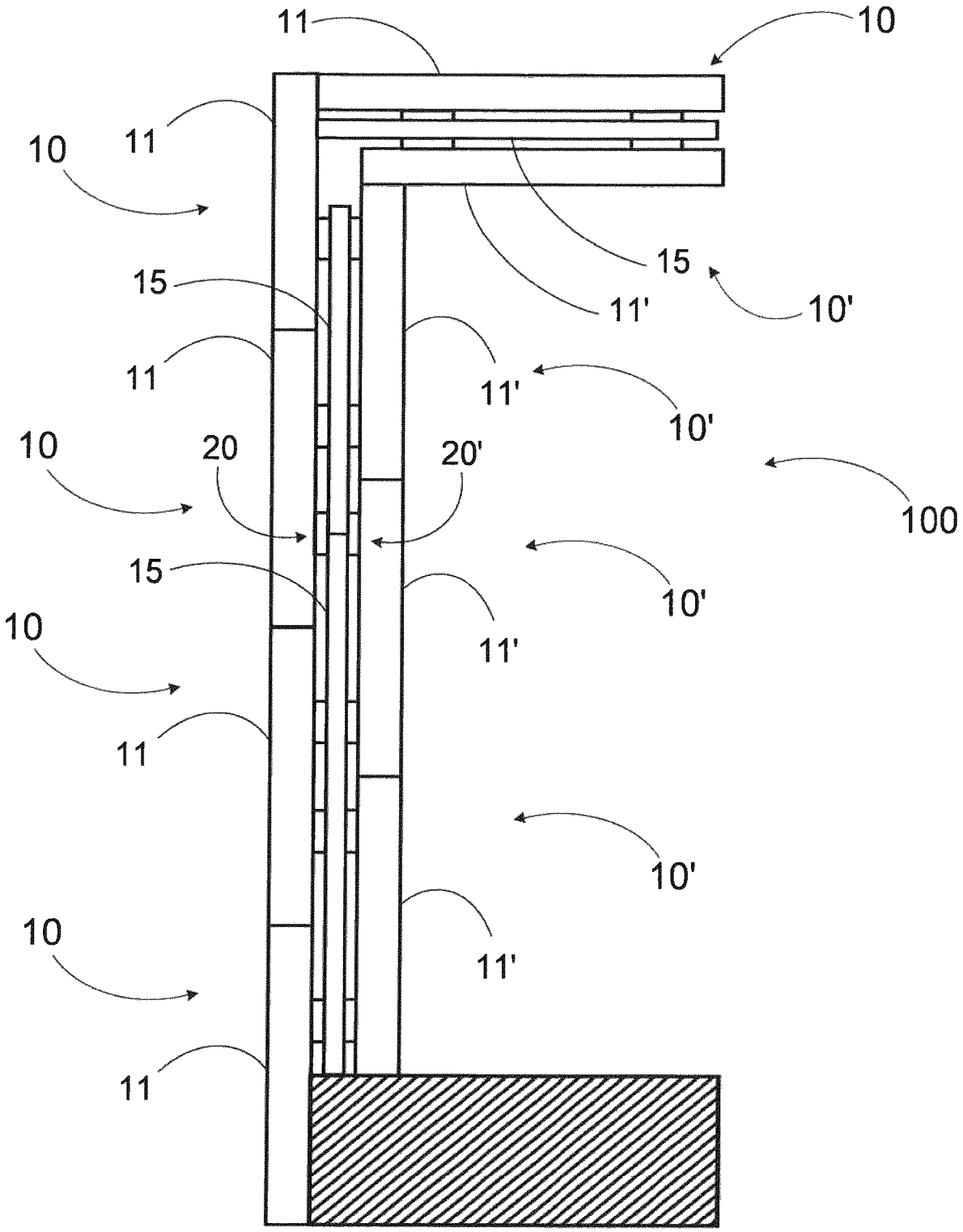
FIG. 10 is a top view of a layout a demountable wall partition system.

The flange connection element 15 may in other examples have a length and being arranged such that the flange connection element 15 partly covers and connects the second end flanges 22, 22', illustrated in e.g. FIG. 10. FIG. 10 illustrates how the flange connection element 15 starts at a top corner of a wall assembled by several demountable partition panels 10 and runs downward over a first pair of second end flanges 22, 22' of a pair of aligned mount brackets 20, 20' and midway to a second pair of second end flanges 22, 22' of the pair of aligned mount brackets 20, 20'. The flange connection element 15 may also be a clip or have a length that is smaller than a width of the second end flanges 22, 22'.

Figure 7:
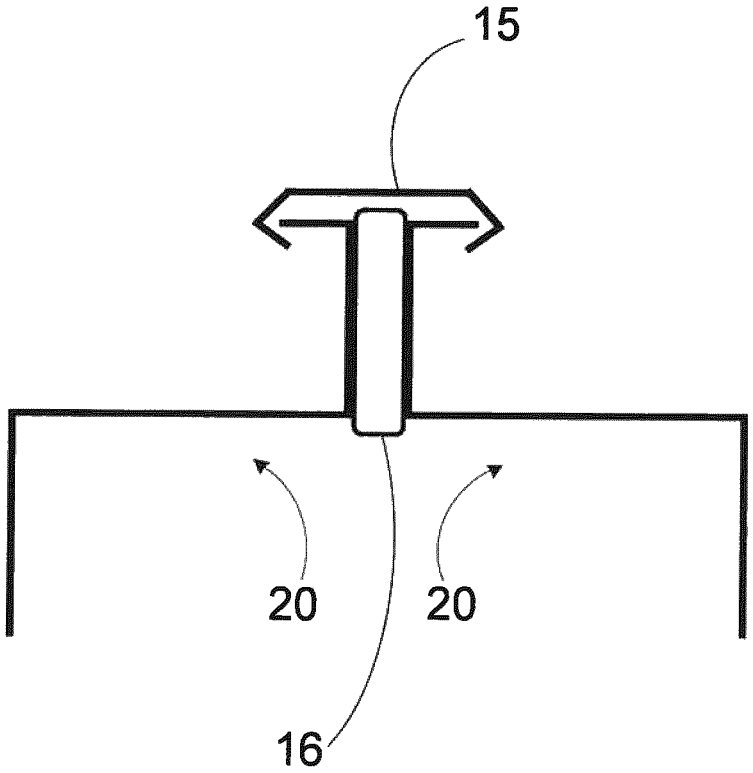
Figure 8:
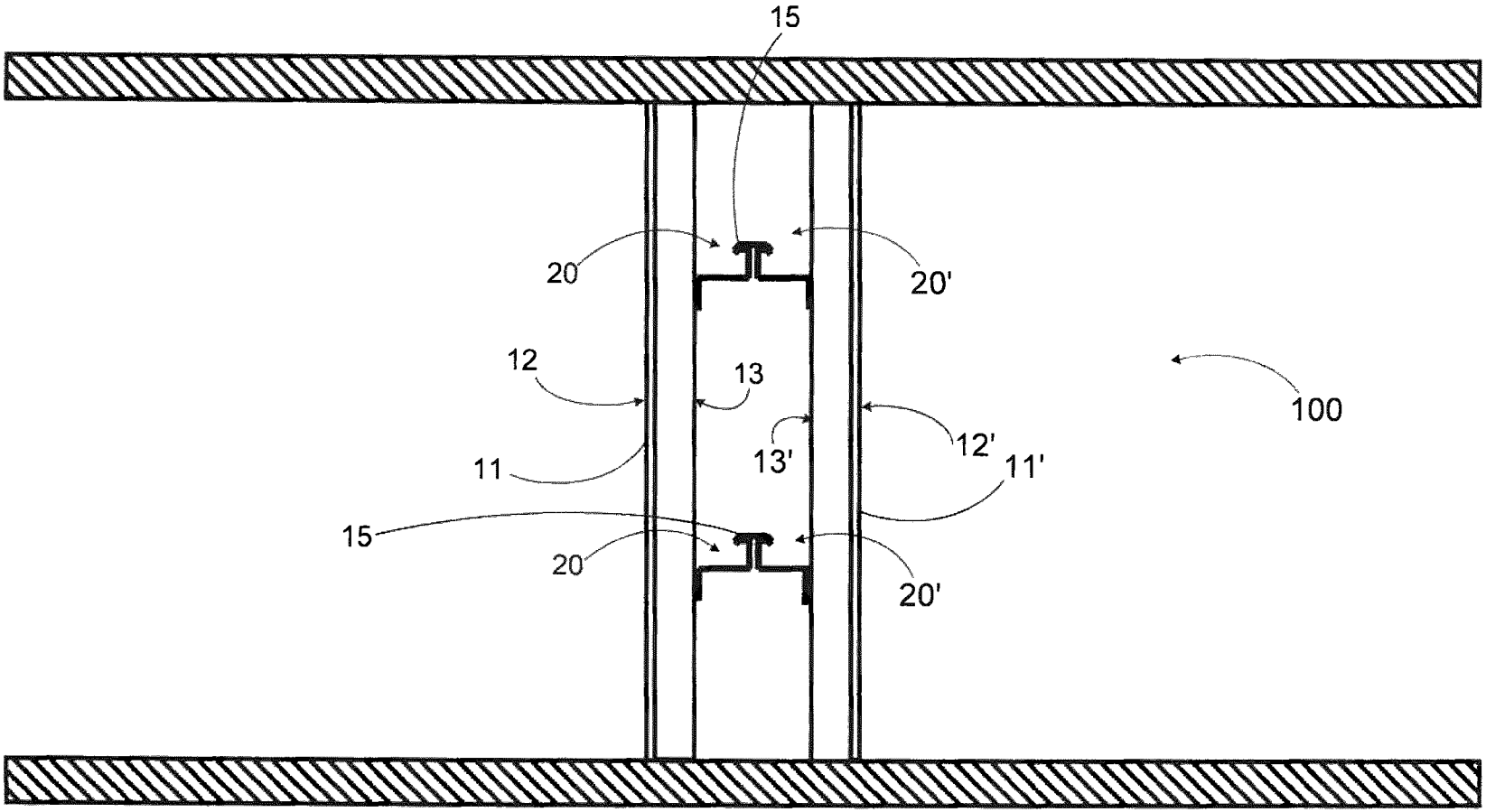
FIG. 8 is a side view of a demountable wall system comprising two demountable partition panels.

As discussed above, the gasket 16 may be arranged between the pair of aligned panel mount brackets 20, 20', illustrated in FIG. 7. The gasket 16 may be pre-attached to one of the second end flanges 22, 22' by for example glue or the gasket 16 may be arranged in between the panel mount brackets 20' when assembling the demountable wall partition system 100. The size of the gasket 16 may be varied depending on for example a desired acoustic dampening between the first and second demountable partition panels 10, FIG. 8 illustrates the demountable wall partition system 100 in place between a ceiling and a floor and having two pairs of aligned mount brackets 20' at different heights. Attaching the demountable wall partition system 100 may be performed with runners attached to the ceiling and/or floor. Other ways of securing the wall from movement and maintaining the office area could be with brackets or block in the ceiling and/or on the floor.

The demountable wall partition panels 10, 10' are installed or assembled into the demountable wall partition system 100 by arranging a first and a second demountable partition panel 10, 10' such that the panel mount bracket 20 of the first demountable partition panel opposes the panel mount bracket 20' of the second demountable partition panel 10'. This can for example be done by standing the first demountable partition panel 10 on the floor of the office space being constructed in an upright manner more or less in a perpendicular direction to the floor of the office space. Next to the first demountable partition panel 10 is the second partition panel 10' then also raised in an upright direction, being more or less perpendicular to the floor of the office space such that the pane mount brackets 20, 20' are opposing each other. As discussed above, the first and second panel mount brackets 20, 20' may abut each other or there may be a slight gap in between the first and second panel mount brackets 20, 20', or the gasket 16 may be arranged between the first and second panel mount brackets 20, 20'.

The first and second panel mount brackets 20, 20' are then connected by means of the flange connection element 15. This connection can be done by sliding, as discussed above, or clamping the flange connection element with the first and second panel mount brackets 20, 20'. The connection by the flange connection element 15 holds together the first and second partition panels 10, 10' in the upright position and so that they are not separated from each other but forms separate inner wall portions. The panel mount bracket of the first demountable partition panel may be level with and/or directly opposed to the panel mount bracket 20' of the second demountable partition panel 10'.

The demountable wall partition system 100 comprises in some examples an insulating material arranged in the void between the first and second demountable partition panels 10, 10'. The insulating material may be arranged in bags and which then can easily be put in the void but also removed later for reuse. It is also additionally possible to run other types of installations in the void such as electrical, plumbing, data and so on, alone or in combination with the insulating material.

Illustrated in FIGS. 9 and 10 are two examples of how to possibly arrange the demountable partition panels 10, 10' for accommodating different room layouts and/or accounting for already existing structural elements in a building. FIG. 9 illustrates that the demountable partition panels 10, 10' can be arranged more or less perfectly opposite each other when forming the wall. FIG. 10 illustrates another setup wherein the demountable partition panels 10, are arranged in an off-set pattern, but still with the panel mount brackets 20' opposite each other, to accommodate a fixed structural element such as an outer wall of the building that the demountable wall partition system 100 is being built in. Other arrangements are of course possible such as for example demountable partition panels 10, 10' having different widths and/or height.

It will be appreciated that the present invention is not limited to the embodiments shown. Several modifications and variations are thus conceivable within the scope of the invention which thus is exclusively defined by the appended claims.

The invention claimed is:

1. A demountable wall partition system (100) comprising:
a first and a second demountable partition panel; and
a flange connection element,
wherein each of the first and second demountable partition panels
has a front surface, a rear surface and side edges connecting the front surface and the rear surface, and
comprises a board having a rear surface forming the rear surface of the associated first or second demountable partition panel and at least one panel mount bracket connected to the board and protruding from the rear surface of the board, the at least one panel mount bracket comprising a first end flange extending in a first flange plane parallel with the rear surface of the board and a second end flange,
wherein the first and second demountable partition panels are arranged spaced apart with the rear surfaces of the associated first and second demountable partition panels facing each other such that the at least one panel mount bracket of the respective first and second demountable partition panel form at least one pair of aligned panel mount brackets,
wherein the at least one pair of aligned panel mount brackets are connected to each other by means of the flange connection element which is connected to the second end flanges of the at least one pair of aligned panel mount brackets such that the flange connection element is supported by the at least one pair of aligned panel mount brackets, and
wherein the demountable wall partition system further comprises a gasket arranged between the at least one pair of aligned panel mount brackets.

2. The demountable wall partition system according to claim 1, wherein the flange connection element is an elongated profile configured to receive the second end flanges of the at least one pair of aligned panel mount brackets.

3. The demountable wall partition system according to claim 2, wherein the elongated profile has a c-shaped cross section.

4. The demountable wall partition system according to claim 1, further comprising an insulating material arranged in a void formed between the first and second demountable partition panels.

5. The demountable wall partition system according to claim 1, wherein the first end flange of the at least one panel mount bracket of the first and/or second demountable partition panel is attached to the rear surface of the board.

6. The demountable wall partition system according to claim 1, wherein at least one of the first and second demountable partition panels comprises an edge cover, the edge cover at least partly covering the side edges.

7. The demountable wall partition system according to claim 6, wherein the edge cover forms a frame structure.

8. The demountable wall partition system according to claim 6, wherein the edge cover comprises an L-shaped profile extending along one of the side edges, the L-shaped profile comprises one flange extending parallel to the one side edge and has a width smaller than a thickness of the associated first or second demountable partition panel.

9. The demountable wall partition system according to claim 1, wherein at least one of the first and second demountable partition panels comprises an additional board facing a front surface of the board.

10. The demountable wall partition system according to claim 9, wherein the board and the additional board are glued together.

11. The demountable wall partition system according to claim 1, wherein the second end flanges of the at least one pair of aligned panel mount brackets each extends in a direction having a component being perpendicular to the associated rear surface of the board.

12. The demountable wall partition system according to claim 11,
wherein each second end flange extends from a first position towards a second position corresponding to a free end of the second end flange, the second position being spaced apart from the associated rear surface of the board, and
wherein a distance between the rear surface of the board and the second position is greater than a distance between the rear surface of the board and the first position.

13. The demountable wall partition system according to claim 1, wherein the board of at least one of the first and second demountable partition panels is a gypsum board.

14. A method for installing a demountable wall partition system according to claim 1, comprising,
arranging the first and second demountable partition panels such that the at least one panel mount bracket of the first demountable partition panel opposes the at least one panel mount bracket of the second demountable partition panel thereby forming at least one pair of aligned panel mount brackets, and connecting the flange connection element to the end flanges of the at least one pair of aligned panel mount brackets such that the flange connection element is supported by the at least one pair of aligned panel mount brackets.

15. The demountable wall partition system according to claim 13, wherein the board of at least one of the first and second demountable partition panels is a reinforced gypsum board.

* * * * *